US011296430B2

(12) United States Patent
Kim et al.

(10) Patent No.: US 11,296,430 B2
(45) Date of Patent: Apr. 5, 2022

(54) ANTENNA MODULE INCLUDING PLURALITY OF RADIATORS, AND BASE STATION INCLUDING THE ANTENNA MODULE

(71) Applicant: Samsung Electronics Co., Ltd., Suwon-si (KR)

(72) Inventors: Hyunjin Kim, Suwon-si (KR); Seungtae Ko, Suwon-si (KR); Yoongeon Kim, Suwon-si (KR); Jungmin Park, Suwon-si (KR); Junsig Kum, Suwon-si (KR); Youngju Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 423 days.

(21) Appl. No.: 16/444,548

(22) Filed: Jun. 18, 2019

(65) Prior Publication Data

US 2019/0393619 A1 Dec. 26, 2019

(30) Foreign Application Priority Data

Jun. 20, 2018 (KR) ..... 10-2018-0071097

(51) Int. Cl.
*H01Q 21/30* (2006.01)
*H01Q 1/24* (2006.01)
(Continued)

(52) U.S. Cl.
CPC ..... *H01Q 21/30* (2013.01); *H01Q 1/246* (2013.01); *H01Q 1/523* (2013.01); *H01Q 21/0025* (2013.01)

(58) Field of Classification Search
CPC ..... H01Q 21/30; H01Q 1/24; H01Q 1/52; H01Q 21/00
(Continued)

(56) References Cited

U.S. PATENT DOCUMENTS

2002/0126048 A1* 9/2002 Zhu ..... H01P 1/181 343/700 MS
2008/0042915 A1 2/2008 Schillmeier et al.
(Continued)

FOREIGN PATENT DOCUMENTS

DE 102006038528 B3 11/2007
EP 3098903 A1 11/2016
(Continued)

OTHER PUBLICATIONS

Extended European Search Report dated Mar. 19, 2021, issued in European Application No. 19823673.9-1205.
(Continued)

*Primary Examiner* — Andrea Lindgren Baltzell
(74) *Attorney, Agent, or Firm* — Jefferson IP Law, LLP

(57) ABSTRACT

A technique for converging Internet of things (IoT) technology with a fifth generation (5G) communication system for supporting data rates beyond a fourth generation (4G) system can be applied to intelligent services. An antenna module includes a first radiator radiating a radio wave through an upper surface, a second radiator formed surrounding an outer periphery of the first radiator, a dielectric having an upper surface disposed under a lower surface of the first radiator, the dielectric being formed to fix the first radiator and the second radiator to be separated based on a first length, a feeder having an upper surface disposed under a lower surface of the dielectric, the feeder coupling an electrical signal to at least one of the radiator or second radiators through the dielectric, and a printed circuit board electrically connected to the feeder by a conductive pattern and supplying the electrical signal to the feeder.

20 Claims, 18 Drawing Sheets

(51) Int. Cl.
*H01Q 1/52* (2006.01)
*H01Q 21/00* (2006.01)

(58) Field of Classification Search
USPC ..... 343/878
See application file for complete search history.

(56) References Cited

U.S. PATENT DOCUMENTS

| | | | | |
|---|---|---|---|---|
| 2008/0218418 | A1 | 9/2008 | Gillette | |
| 2014/0159979 | A1* | 6/2014 | Foo | H01Q 5/42 343/833 |
| 2015/0130682 | A1 | 5/2015 | Jung et al. | |
| 2016/0248171 | A1* | 8/2016 | John | H01Q 19/12 |
| 2017/0012364 | A1 | 1/2017 | Yang et al. | |
| 2017/0194703 | A1 | 7/2017 | Watson | |
| 2018/0123222 | A1 | 5/2018 | Jang et al. | |

FOREIGN PATENT DOCUMENTS

| | | | |
|---|---|---|---|
| JP | 2007-235592 | A | 9/2007 |
| KR | 10-2012-0140080 | A | 12/2012 |

OTHER PUBLICATIONS

International Search Report dated Sep. 26, 2019, issued in International Application No. PCT/KR2019/007354.
Written Opinion dated Sep. 26, 2019, issued in International Application No. PCT/KR2019/007354.

* cited by examiner

<RELATED ART> <DISCLOSURE>

ANTENNA MODULE INCLUDING PLURALITY OF RADIATORS, AND BASE STATION INCLUDING THE ANTENNA MODULE

CROSS-REFERENCE TO RELATED APPLICATION(S)

This application is based on and claims priority under 35 U.S.C. § 119(a) of a Korean patent application number 10-2018-0071097, filed on Jun. 20, 2018, in the Korean Intellectual Property Office, the disclosure of which is incorporated by reference herein in its entirety.

BACKGROUND

1. Field

The disclosure relates to an antenna module having improved communication efficiency for next generation communication technologies and to an electronic device including the antenna module.

2. Description of Related Art

In order to satisfy the increasing demands of radio data traffic after the commercialization of a fourth generation (4G) communication system, efforts have been made to develop an advanced fifth generation (5G) communication system or a pre-5G communication system. For this reason, the 5G communication system or the pre-5G communication system are also referred to as a beyond-4G network communication system or a post-long term evolution (LTE) system. In order to accomplish a higher data transfer rate, the implementation of the 5G communication system in a super-high frequency (mmWave) band (e.g., a 60 GHz band) is being considered. Also, in order to obviate a propagation loss of a radio wave and increase a delivery distance of a radio wave in the super-high frequency band, discussions for the 5G communication system are underway about various techniques such as a beamforming, a massive multiple-input multiple-output (MIMO), a full dimensional MIMO (FD-MIMO), an array antenna, an analog beam-forming, and a large scale antenna. Additionally, for an improvement in network of the 5G communication system, technical developments are being made in an advanced small cell, a cloud radio access network (cloud RAN), an ultra-dense network, a device to device (D2D) communication, a wireless backhaul, a moving network, a cooperative communication, coordinated multi-points (CoMP), a reception-end interference cancellation, and the like. Also, in the 5G communication system, a hybrid frequency-shift keying (FSK) and quadrature amplitude modulation (QAM) modulation (FQAM) and a sliding window superposition coding (SWSC) are developed as advanced coding modulation (ACM) schemes, and a filter bank multi carrier (FBMC), a non-orthogonal multiple access (NOMA), and a sparse code multiple access (SCMA) are also developed as advanced access techniques.

Meanwhile, the Internet, which is a human centered connectivity network where humans generate and consume information, is now evolving to the Internet of things (IoT) where distributed entities, such as things, exchange and process information without human intervention. Further, the Internet of everything (IoE), which is a combination of IoT technology and big data processing technology through connection with a cloud server, has emerged. As technology elements, such as sensing technology, wired/wireless communication and network infrastructure, service interface technology, and security technology, have been demanded for IoT implementation, a sensor network, machine-to-machine (M2M) communication, machine type communication (MTC), and so forth have been recently researched. Such an IoT environment may provide intelligent Internet technology services that create a new value to human life by collecting and analyzing data generated among connected things. The IoT may be applied to a variety of fields including smart home, smart building, smart city, smart car or connected car, smart grid, health care, smart appliances, advanced medical service, etc. through convergence and combination between existing information technology (IT) and various industrial applications.

In line with this, various attempts have been made to apply the 5G communication system to the IoT network. For example, technologies such as a sensor network, machine type communication (MTC), and machine-to-machine (M2M) communication are being implemented on the basis of 5G communication technologies such as beamforming, MIMO, and an array antenna. The use of a cloud radio access network (cloud RAN) for big data processing technology is one example of convergence between the 5G technology and the IoT technology.

As described above, in a frequency band applied to the next generation mobile communication system, the performance of an antenna module may be deteriorated due to a propagation loss of a radio wave, or the like. Therefore, in the next generation mobile communication system, an improved structure of an antenna module for solving such a problem is required. Specifically, an antenna module structure capable of smooth and reliable communication in a massive multiple input multiple output (MIMO) communication environment is needed.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an antenna module. Additional aspects will be set forth in part in the description which follows and, in part, will be apparent from the description, or may be learned by practice of the presented embodiments.

In accordance with an aspect of the disclosure an antenna module is provided. The antenna module includes a first radiator radiating a radio wave through an upper surface, a second radiator formed to surrounding an outer periphery of the first radiator, a dielectric having an upper surface disposed under a lower surface of the first radiator, the dielectric being formed to fix the first radiator and the second radiator to be separated from each other based on a predetermined first length, a feeder having an upper surface disposed under a lower surface of the dielectric, the feeder coupling an electrical signal to at least one of the first radiator or the second radiator through the dielectric, and a printed circuit board (PCB) electrically connected to the feeder by a conductive pattern and supplying the electrical signal to the feeder.

The lower surface of the first radiator and the upper surface of the feeder are separated based on a predetermined second length by the dielectric, and the predetermined second length may be determined based on frequency characteristics of the radio wave radiated by the first radiator.

The second radiator is formed of a barrier having a predetermined height which surrounds laterally the first radiator.

A height of an upper surface of the second radiator may be greater than a height of an upper surface of the first radiator.

A height difference between the first radiator and the second radiator may be determined based on frequency characteristics of the radio wave radiated by the first radiator.

A plurality of sub-second radiators segmented from the second radiator are disposed along the outer periphery of the first radiator.

Each of the sub-second radiators includes a first segment disposed in parallel with the upper surface of the first radiator, and a second segment extending from an end of the first segment toward the PCB.

An area of an upper surface of the first segment may be determined based on frequency characteristics of the radio wave radiated by the first radiator.

A height of an upper surface of the first segment may be greater than a height of the upper surface of the first radiator.

The antenna module may further include a supporter formed of a metallic material and disposed under the lower surface of the dielectric so that an upper surface of the PCB is separated from the lower surface of the dielectric based on a predetermined third length.

A height of a lower surface of the first radiator may be greater than a height of a lower surface of the second radiator.

One end of the second radiator may be disposed within the dielectric.

In accordance with another aspect of the disclosure, a base station is provided. The base station includes an antenna module that includes a first radiator radiating a radio wave through an upper surface, a second radiator formed to surrounding an outer periphery of the first radiator, a dielectric having an upper surface disposed under a lower surface of the first radiator, the dielectric being formed to fix the first radiator and the second radiator to be separated from each other based on a predetermined first length, a feeder having an upper surface disposed under a lower surface of the dielectric, the feeder coupling an electrical signal to at least one of the first radiator or the second radiator through the dielectric, and a PCB electrically connected to the feeder by a conductive pattern and supplying the electrical signal to the feeder.

The lower surface of the first radiator and the upper surface of the feeder are separated based on a predetermined second length by the dielectric, and the predetermined second length may be determined based on frequency characteristics of the radio wave radiated by the first radiator.

The second radiator is formed of a barrier having a predetermined height which surrounds laterally the first radiator.

A height of an upper surface of the second radiator may be greater than a height of an upper surface of the first radiator.

A height difference between the first radiator and the second radiator may be determined based on frequency characteristics of the radio wave radiated by the first radiator.

A plurality of sub-second radiators segmented from the second radiator are disposed along the outer periphery of the first radiator.

Each of the sub-second radiators includes a first segment disposed in parallel with the upper surface of the first radiator, and a second segment extending from an end of the first segment toward the PCB.

An area of an upper surface of the first segment may be determined based on frequency characteristics of the radio wave radiated by the first radiator.

A height of an upper surface of the first segment may be greater than a height of the upper surface of the first radiator.

The antenna module may further include a supporter formed of a metallic material and disposed under the lower surface of the dielectric so that an upper surface of the PCB is separated from the lower surface of the dielectric based on a predetermined third length.

A height of a lower surface of the first radiator may be greater than a height of a lower surface of the second radiator.

One end of the second radiator may be disposed within the dielectric.

In accordance with yet another aspect of the disclosure a base station including a plurality of antenna arrays is provided. Each of the plurality of antenna arrays includes at least one antenna module, and each of the at least one antenna module includes a first radiator radiating a radio wave through an upper surface, a second radiator formed to surrounding an outer periphery of the first radiator, a dielectric having an upper surface disposed under a lower surface of the first radiator, the dielectric being formed to fix the first radiator and the second radiator to be separated from each other based on a predetermined first length, a feeder having an upper surface disposed under a lower surface of the dielectric, the feeder coupling an electrical signal to at least one of the first radiator or the second radiator through the dielectric, and a PCB electrically connected to the feeder by a conductive pattern and supplying the electrical signal to the feeder.

A part of the radio wave radiated by the first radiator may be reflected by the second radiator and then radiated to an outside of the antenna module.

The antenna array may include a first antenna module and a second antenna module, and the first antenna module may include a third radiator radiating a radio wave through an upper surface, and a fourth radiator formed to surround laterally the upper surface of the third radiator. A part of the radio wave radiated from the upper surface of the third radiator to the second antenna module is blocked by the fourth radiator.

According to embodiments of the disclosure, antenna performance can be improved in a super-high frequency band used in the next generation communication system. Specifically, a structure of an antenna module including a plurality of radiators can increase an effective area of a radio wave radiated from the antenna module, thereby improving a gain value of the antenna module.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
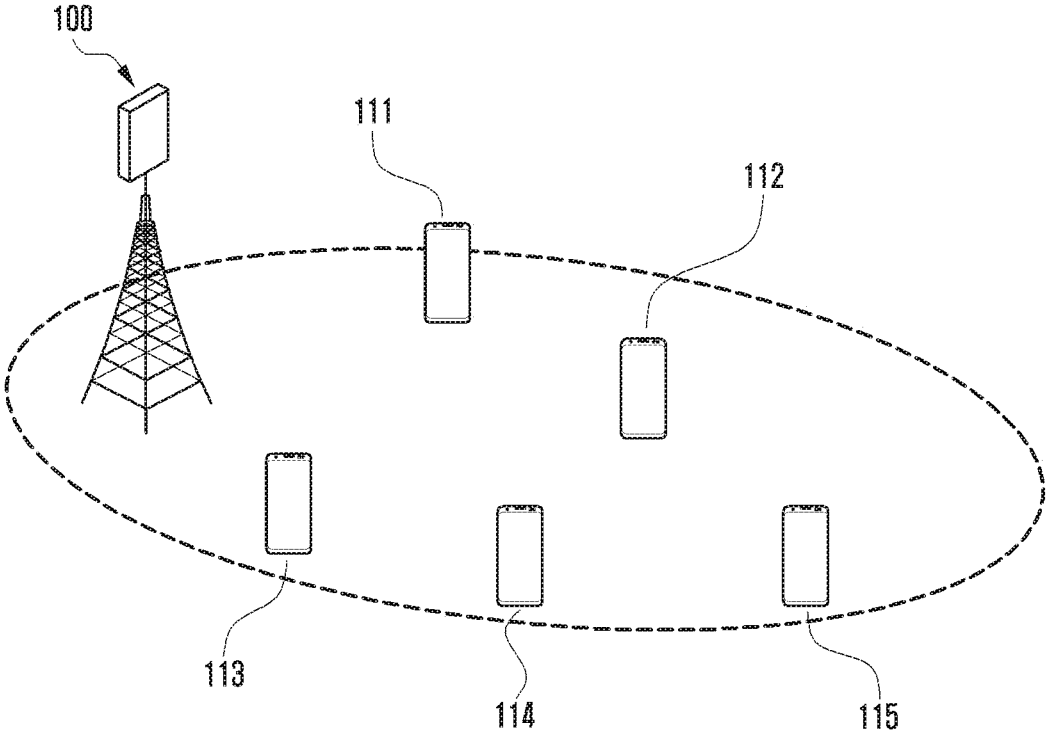
FIG. 1 is a schematic diagram illustrating a massive multiple-input multiple-output (MIMO) environment according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following description of embodiments, descriptions of techniques that are well known in the art and not directly related to the disclosure are omitted. This is to clearly convey the subject matter of the disclosure by omitting any unnecessary explanation.

For the same reason, some elements in the drawings are exaggerated, omitted, or schematically illustrated. Also, the size of each element does not entirely reflect the actual size. In the drawings, the same or corresponding elements are denoted by the same reference numerals.

The advantages and features of the disclosure and the manner of achieving them will become apparent with reference to the embodiments described in detail below and with reference to the accompanying drawings. The disclosure may, however, be embodied in many different forms and should not be construed as being limited to the embodiments set forth herein. Rather, these embodiments are provided so that this disclosure will be thorough and complete and will fully convey the scope of the disclosure to those skilled in the art. To fully disclose the scope of the disclosure to those skilled in the art, the disclosure is only defined by the scope of claims.

It will be understood that each block of the flowchart illustrations, and combinations of blocks in the flowchart illustrations, may be implemented by computer program instructions. These computer program instructions may be provided to a processor of a general purpose computer, special purpose computer, or other programmable data processing apparatus to produce a machine, such that the instructions, which are executed via the processor of the computer or other programmable data processing apparatus, generate means for implementing the functions specified in the flowchart block or blocks. These computer program instructions may also be stored in a computer usable or computer-readable memory that may direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that are executed on the computer or other programmable apparatus provide steps for implementing the functions specified in the flowchart block or blocks.

In addition, each block of the flowchart illustrations may represent a module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

The term "unit", as used herein, refers to a software or hardware component or device, such as a field programmable gate array (FPGA) or application specific integrated circuit (ASIC), which performs certain tasks. A unit may be configured to reside on an addressable storage medium and configured to execute on one or more processors. Thus, a module or unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or further separated into additional components and modules. In addition, the components and units may be implemented to operate one or more central processing units (CPUs) in a device or a secure multimedia card. In embodiments, a certain unit may include one or more processors.

The disclosure provides an antenna module structure capable of improving the performance of an antenna module in the next generation mobile communication system. Specifically, the disclosure provides an antenna module including a dielectric and a supporter for supporting the dielectric in a first embodiment, and also provides an antenna module using a metal structure in a second embodiment. Hereinafter, the structure of the antenna modules according to the first and second embodiments will be described in detail.

FIG. 1 is a schematic diagram illustrating a massive multiple-input multiple-output (MIMO) environment according to an embodiment of the disclosure.

Referring to FIG. 1, in the massive multiple input multiple output (MIMO) environment, a single base station 100 may include a plurality of antenna arrays and perform communication with a plurality of terminals 111, 112, 113, 114, and 115.

Meanwhile, in the next generation communication system, a beamforming technique is applied to reduce a propagation loss of a radio wave in a super-high frequency band as described above. Therefore, for smooth beamforming of each antenna array disposed in the base station, the spacing between the antenna arrays is reduced and thereby the beam width of each antenna array is secured.

However, in a case of reducing the spacing between the antenna arrays of the base station 100 so as to secure the beam width of the antenna array, interference between the antenna arrays may occur, which may degrade the performance of the antenna array.

Accordingly, in the next generation communication system that employs the beamforming technique, an improved structure of an antenna module for addressing the above-mentioned problem is desired.

Figure 2:
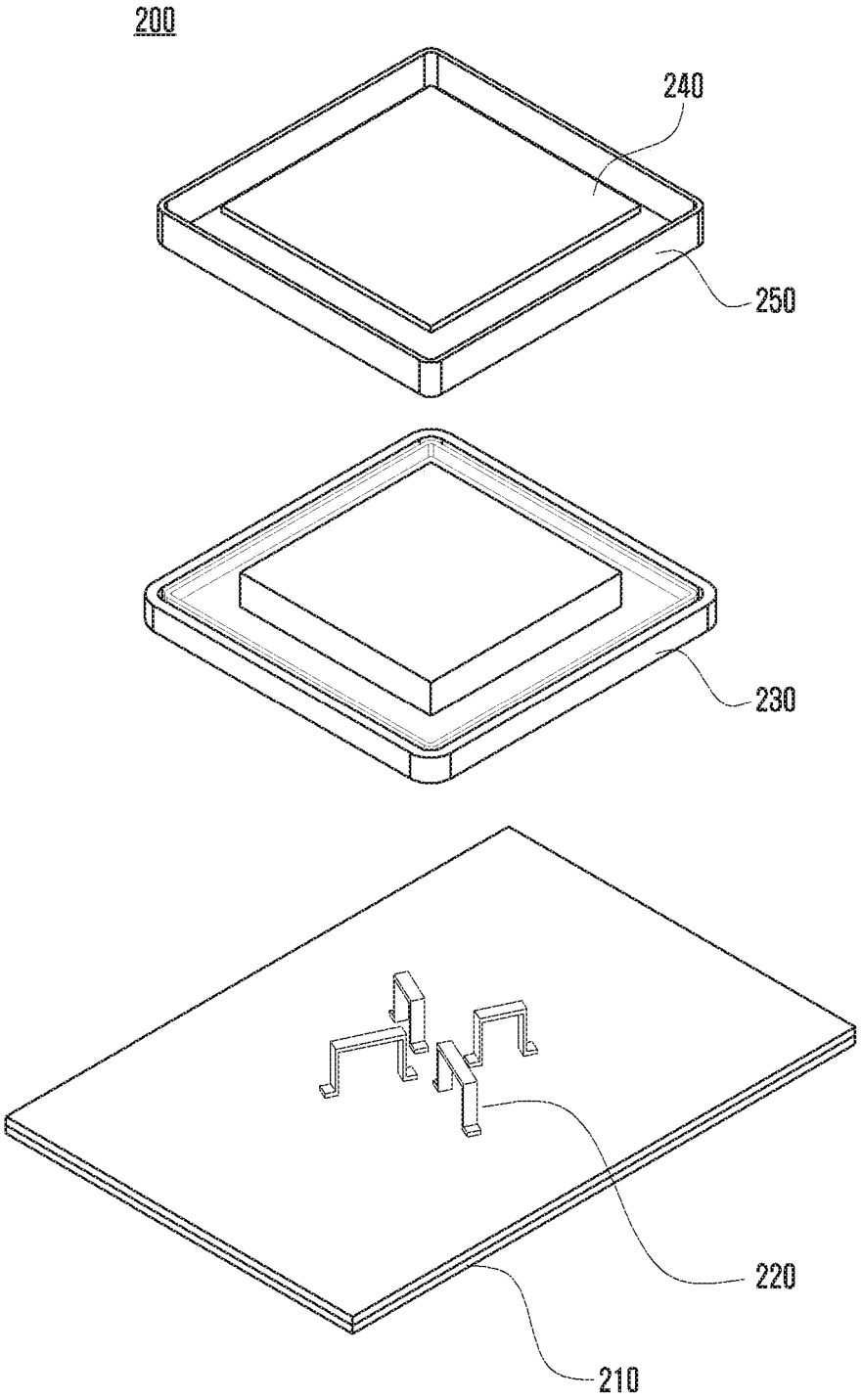
FIG. 2 is an exploded perspective view illustrating a structure of an antenna module according to an embodiment of the disclosure.

FIG. 2 is an exploded perspective view illustrating a structure of an antenna module according to an embodiment of the disclosure.

Referring to FIG. 2, an antenna module 200 may include a first radiator 240, a second radiator 250, a dielectric 230, a feeder 220, and a printed circuit board (PCB) 210. The first radiator 240 radiates a radio wave through an upper surface thereof. The second radiator 250 is formed to surround laterally the first radiator 240. The dielectric 230 has an upper surface disposed under a lower surface of the first radiator 240, and is formed to fix the first radiator 240 and the second radiator 250 to be spaced apart from each other by a predetermined first length. The feeder 220 has an upper surface disposed under a lower surface of the dielectric 230 and delivers an electrical signal to the first radiator 240 or the second radiator 250 through the dielectric 230. The PCB 210 is electrically connected to the feeder 220 through a conductive pattern thereof and supplies the electrical signal to the feeder 220.

According to an embodiment, the first radiator 240 may be a patch-type antenna. The first radiator 240 may receive an electric signal from the feeder 220 through the dielectric 230 and radiate a radio wave of a specific frequency outwardly.

According to an embodiment, the lower surface of the first radiator 240 and the upper surface of the feeder 220 may be spaced apart by a predetermined length by the dielectric 230. That is, the first radiator 240 and the feeder 220 are not directly connected to each other, but the dielectric 230 is interposed between the first radiator 240 and the feeder 220. Therefore, a gap-coupled structure is formed in the antenna module.

According to an embodiment, the gap-coupled structure has the effect of disposing a capacitor or an inductor between the first radiator 240 and the feeder 220. It is therefore possible to improve a bandwidth of a radio wave radiated through the first radiator 240. A distance between the feeder 220 and the first radiator 240 may be determined based on frequency characteristics of a radio wave radiated through the first radiator 240.

According to an embodiment, the second radiator 250 is formed of a barrier shape having a predetermined height, surrounding laterally the first radiator 240. The second radiator 250 can increase an effective area of radio wave radiation of the antenna module and thereby improve a gain value of the antenna module.

According to an embodiment, the first radiator 240 of a patch shape may extend in a horizontal direction of the antenna module 200, whereas the second radiator 250 of a barrier shape may extend in a vertical direction of the antenna module 200. That is, a combination of the horizontally extending first radiator and the vertically extending second radiator can improve the effective area of radio wave radiation of the antenna module.

Figure 3A:
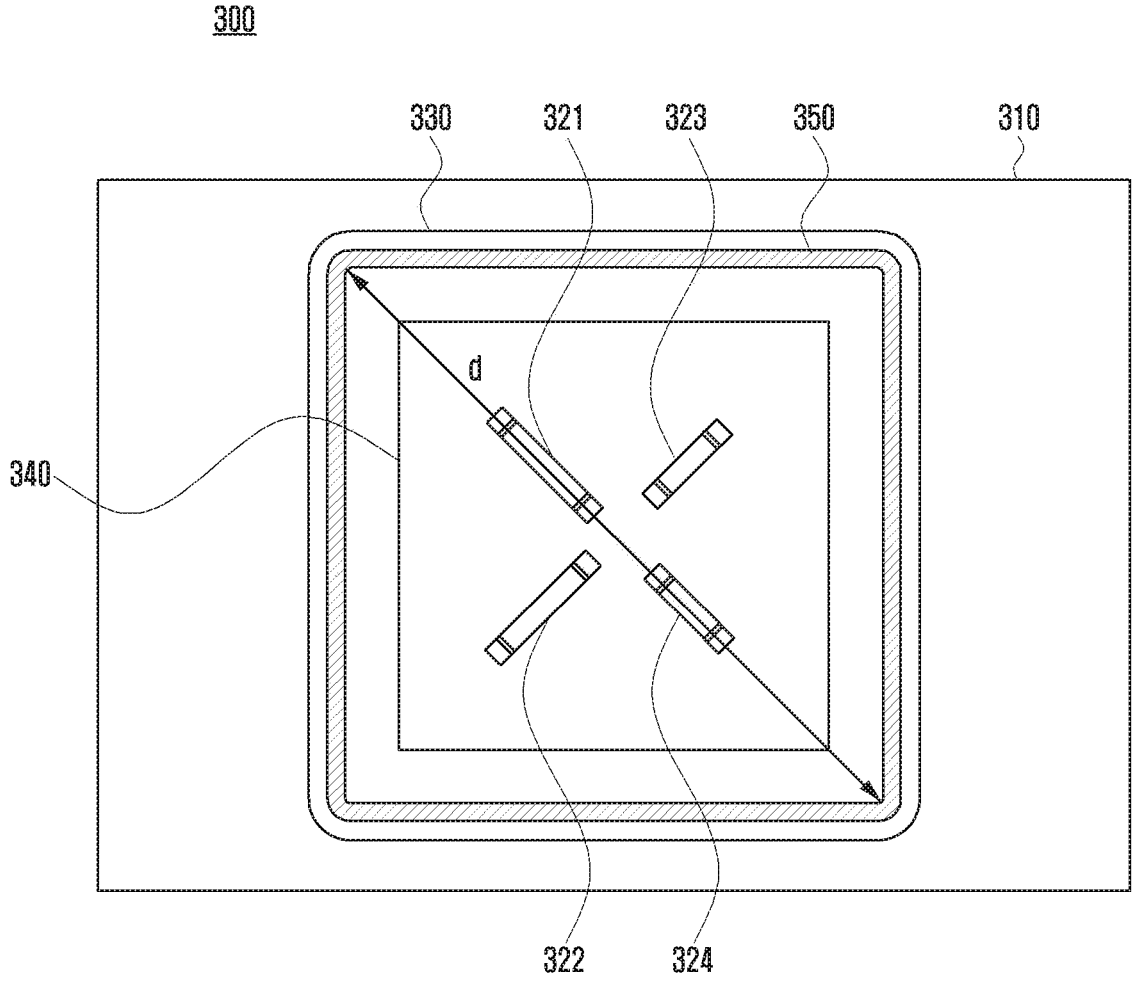
FIG. 3A is a top plan view illustrating an antenna module structure, supposing penetration, according to an embodiment of the disclosure.

FIG. 3A is a top plan view illustrating an antenna module structure, supposing penetration, according to an embodiment of the disclosure.

Referring to FIG. 3A, in a top plan view, a first radiator 340 may be a patch-type rectangular antenna. In addition, a second radiator 350 may be a closed loop barrier surrounding laterally the first radiator 340 while being spaced apart from the first radiator 340.

According to an embodiment, a feeder may include a first feeder 321 and a second feeder 322. The first feeder 321 supplies an electrical signal related to horizontal polarization to the first radiator 340 disposed on an upper surface of a dielectric 330, and the second feeder 322 supplies an electrical signal related to vertical polarization to the first radiator 340.

According to an embodiment, on a lower surface of the dielectric 330, an extension line of the first feeder 321 and an extension line of the second feeder 322 may be perpendicular to each other. This perpendicular arrangement of the first and second feeders 321 and 322 improves an isolation between the horizontal polarization and the vertical polarization.

According to an embodiment, an antenna module 300 may include supporters 323 and 324 formed of a metallic material and disposed under the lower surface of the dielectric 330 so that an upper surface of a PCB 310 is spaced apart from the lower surface of the dielectric 330 by a predetermined length.

According to an embodiment, the supporters 323 and 324 may have the same shape as or different shapes from the first and second feeders 321 and 322. However, even in case where the supporters 323 and 324 are different in shape from the first and second feeders 321 and 322, the supporters 323 and 324 may have the same height as that of the first and second feeders 321 and 322 in order to allow the dielectric 330 to be parallel with the PCB 310.

According to an embodiment, the first and second supporters 323 and 324 may change a distribution of an electric field generated by an electric signal flowing in each of the first and second feeders 321 and 322. That is, the metallic material of the first and second supporters 323 and 324 may cause an improvement in isolation performance of the antenna module 300.

According to an embodiment, the degree of such an improvement in isolation performance of the antenna module 300 may be determined according to the dimension of an area where the first and second supporters 323 and 324 are in contact with the lower surface of the dielectric 330.

Meanwhile, contrary to the above-described embodiment, in an alternative embodiment, the first feeder 321 may supply an electrical signal related to vertical polarization, and the second feeder 322 may supply an electrical signal related to horizontal polarization.

Figure 3B:
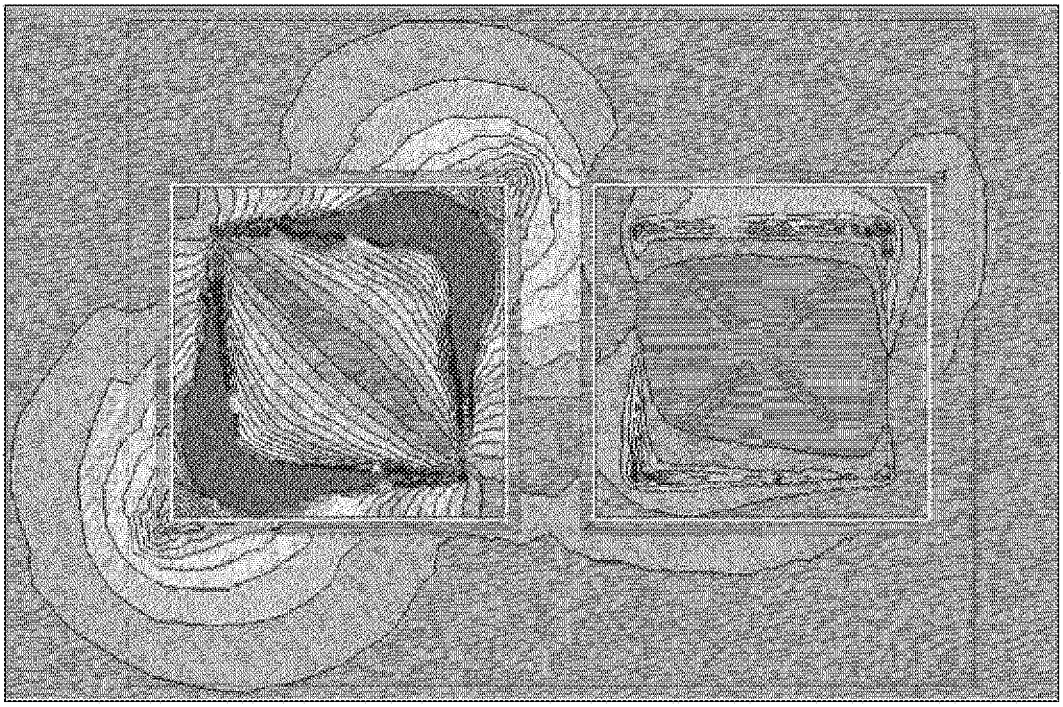
FIG. 3B is a view illustrating a reduction effect of mutual coupling between antenna modules in an antenna module structure according to an embodiment of the disclosure.

FIG. 3B is a view illustrating a reduction effect of mutual coupling between antenna modules in an antenna module structure according to an embodiment of the disclosure.

Specifically, FIG. 3B shows an electromagnetic field distribution of the antenna module structure shown in FIG. 3A.

Referring to FIG. 3B, the electromagnetic field distribution produced by a radio wave radiation of the first radiator is formed close to the antenna module including the first radiator. Therefore, the antenna performance degradation due to the mutual coupling between the antenna arrays can be reduced.

That is, according to the disclosure, the second radiator is capable of blocking a radio wave radiated toward a neighboring antenna module among radio waves radiated through the first radiator included in the antenna module. Therefore, the electromagnetic field distribution of the antenna module may be exhibited as shown in FIG. 3B. According to an embodiment, the second radiator 350 included in the antenna module may be disposed at a peak position of the electromagnetic field inside the antenna module. This can reduce a phenomenon of mutual coupling in the air. According to an embodiment, in FIG. 3A, a diagonal length (d) of the second radiator 350 may be determined based on a wavelength ($\lambda$) of a radio wave radiated through the first radiator 340 (e.g., $d=\lambda/2$).

Figure 4A:
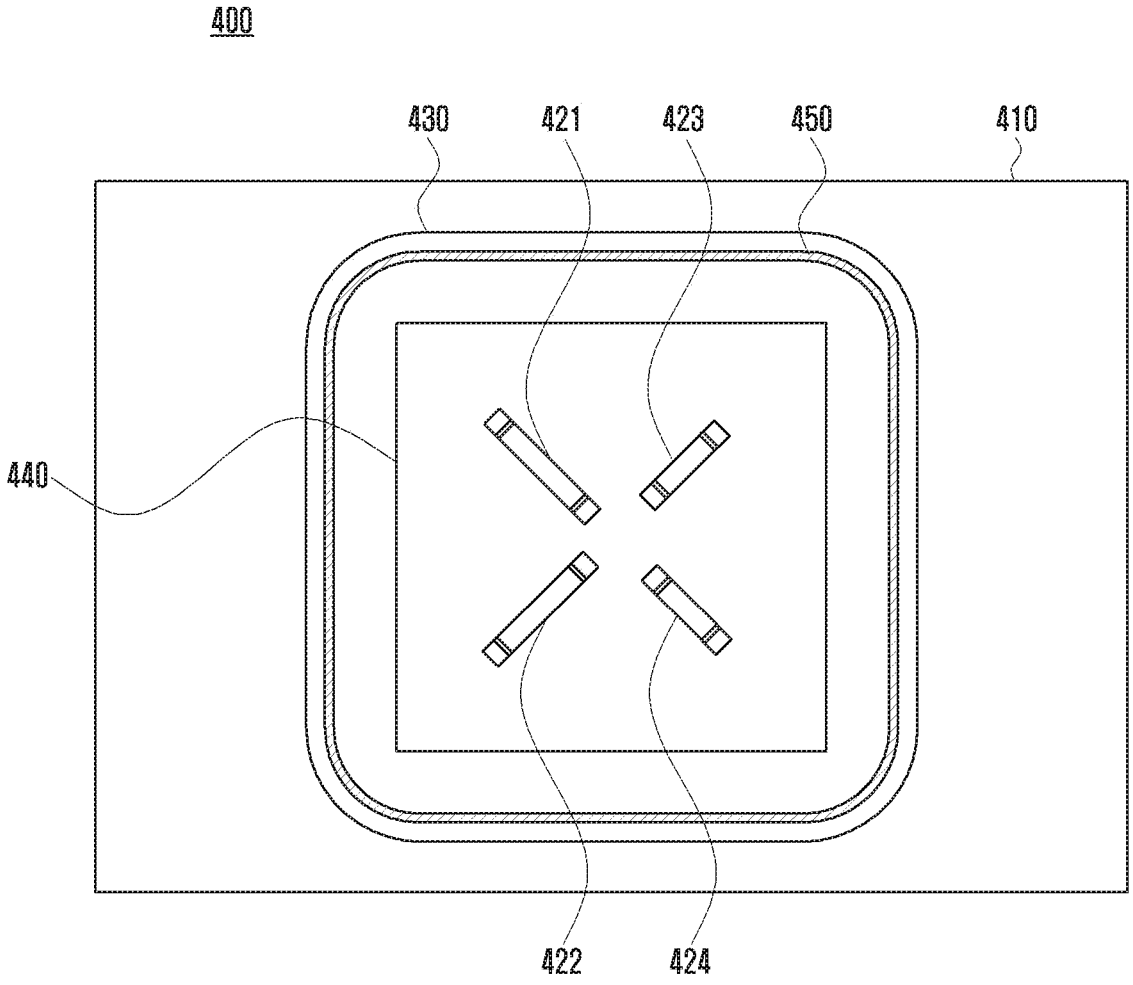
FIG. 4A is a top plan view illustrating an antenna module structure, supposing penetration, according to an embodiment of the disclosure.

FIG. 4A is a top plan view illustrating an antenna module structure, supposing penetration, according to an embodiment of the disclosure.

Referring to FIG. 4A, the second radiator of the antenna module may have various shapes. For example, the shape of a second radiator 450 shown in FIG. 4A is different from that of the second radiator 350 shown in FIG. 3A. Specifically, the second radiator 350 shown in FIG. 3A is formed in a rectangular shape similar to an outward form (i.e., rectangular) of the first radiator 340, whereas the second radiator 450 shown in FIG. 4A is formed in a rectangular-like shape having round corners obtained through a rounding process. Such round corners of the second radiator 450 can reduce the mutual coupling phenomenon that a radio wave radiated through the antenna module affects a neighboring antenna module.

Except for the shape of the second radiator 450, the structure of the antenna module 400 (namely, a PCB 410, feeders 421 and 422, supporters 423 and 424, a dielectric 430, and a first radiator 440) shown in FIG. 4A may be the same as or similar to the antenna module structure shown in FIG. 3A.

Figure 4B:
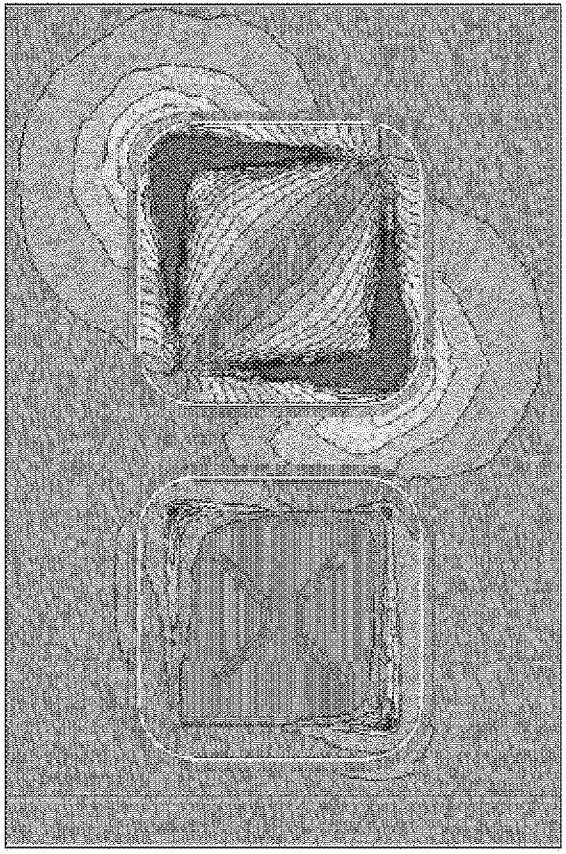
FIG. 4B is a view illustrating a distribution of an electromagnetic field in the antenna module structure of FIG. 4A according to an embodiment of the disclosure.

FIG. 4B is a view illustrating a distribution of an electromagnetic field in the antenna module structure of FIG. 4A according to an embodiment of the disclosure.

In comparison with the electromagnetic field distribution shown in FIG. 3B, the electromagnetic field distribution shown in FIG. 4B shows that the effect of reducing the mutual coupling phenomenon between the antenna modules is greater when the second radiator has round corners. That is, through the structure of FIG. 4A, the isolation between the antenna arrays can be improved.

Figure 4C:
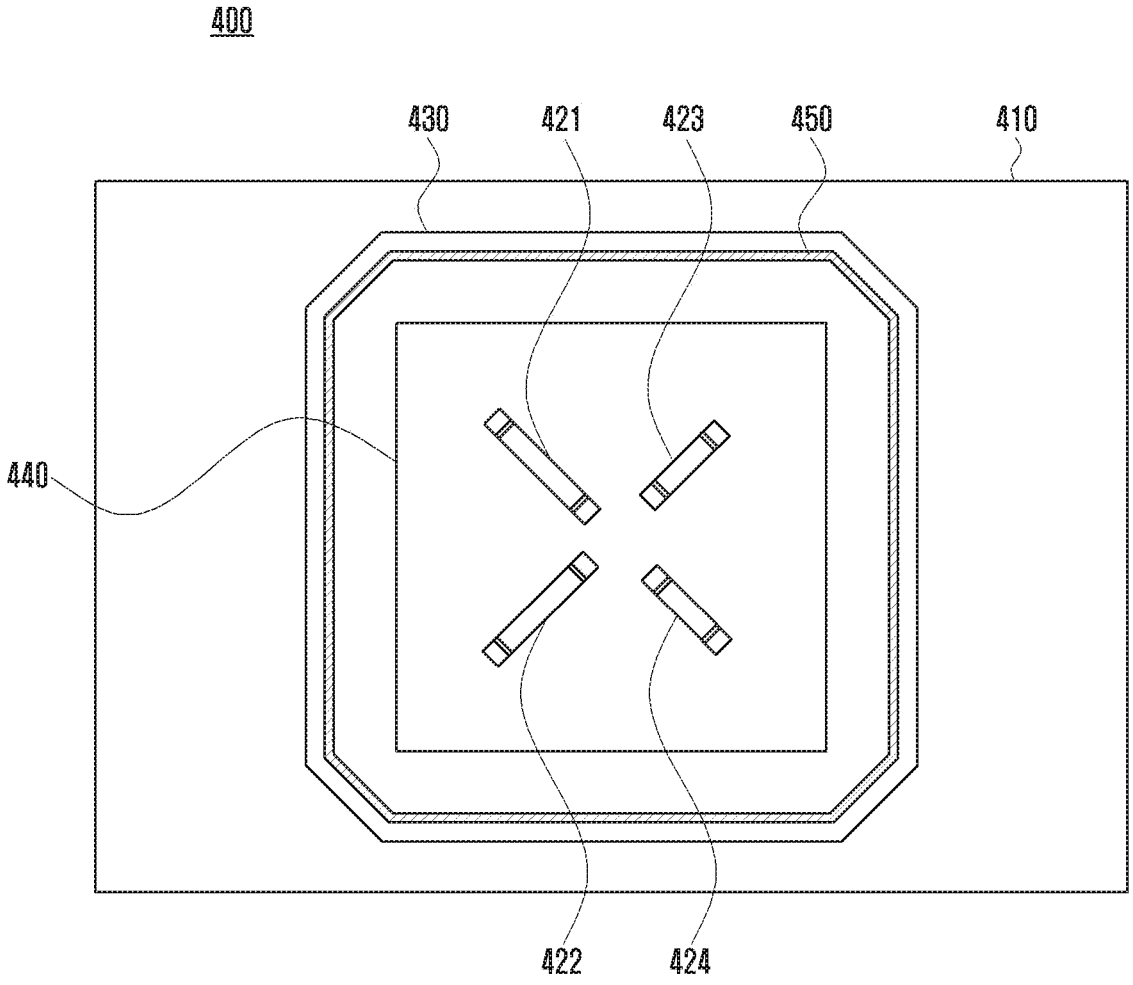
FIG. 4C is a top plan view illustrating an antenna module structure, supposing penetration, according to an embodiment of the disclosure.

FIG. 4C is a top plan view illustrating an antenna module structure, supposing penetration, according to an embodiment of the disclosure.

Referring to FIG. 4C, the shape of the second radiator 450 shown in FIG. 4C is different from that of the second radiator 350 shown in FIG. 3A. Specifically, the second radiator 350 shown in FIG. 3A is formed in a rectangular shape similar to an outward form (i.e., rectangular) of the first radiator 340, whereas the second radiator 450 shown in FIG. 4C is formed in an octagonal shape. The octagonal shape of the second radiator 450 can reduce the mutual coupling phenomenon that a radio wave radiated through the antenna module affects a neighboring antenna module.

Except for the shape of the second radiator 450, the structure of the antenna module 400 (namely, a PCB 410, feeders 421 and 422, supporters 423 and 424, a dielectric 430, and a first radiator 440) shown in FIG. 4C may be the same as or similar to the antenna module structure shown in FIG. 3A.

Figure 4D:
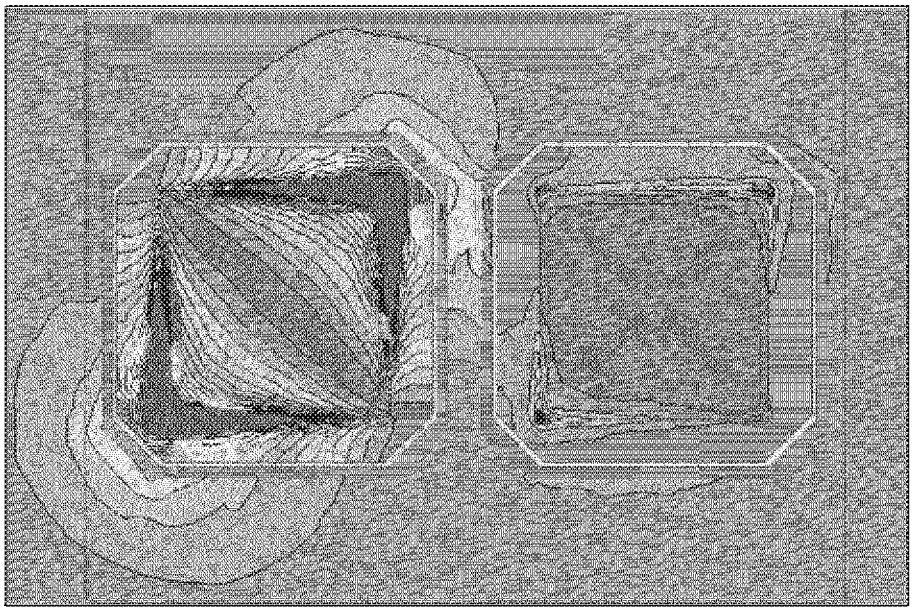
FIG. 4D is a view illustrating a distribution of an electromagnetic field in the antenna module structure of FIG. 4C according to an embodiment of the disclosure.

FIG. 4D is a view illustrating a distribution of an electromagnetic field in the antenna module structure of FIG. 4C according to an embodiment of the disclosure.

Referring to FIG. 4D, in comparison with the electromagnetic field distribution shown in FIG. 3B, the electromagnetic field distribution shown in FIG. 4D shows that the effect of reducing the mutual coupling phenomenon between the antenna modules is greater when the second radiator is formed in an octagonal shape. That is, through the structure of FIG. 4C, the isolation between the antenna arrays can be improved.

Figure 5:
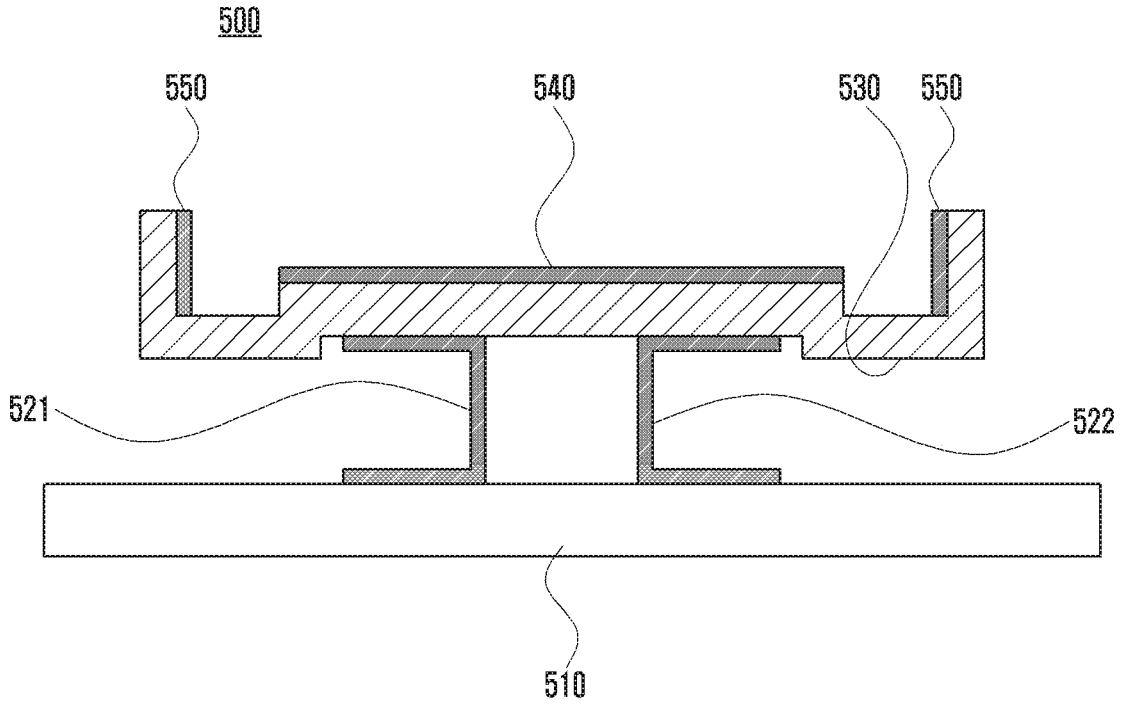
FIG. 5 is a side view illustrating an antenna module structure according to an embodiment of the disclosure.

FIG. 5 is a side view illustrating an antenna module structure according to an embodiment of the disclosure.

Referring to FIG. 5, an antenna module 500 is shown in which the height of an upper surface of a second radiator 550 may be greater than the height of an upper surface of a first radiator 540. Because of such a difference in height, a radio wave radiated through the first radiator 540 may not pass through the second radiator 550. This may prevent the mutual coupling phenomenon between antenna modules.

According to an embodiment, a height difference between the first radiator 540 and the second radiator 550 may be determined based on frequency characteristics of the radio wave radiated through the first radiator 540. For example, the height difference, h, between the first and second radiators 540 and 550 may satisfy the following Equation 1.

$$h \leq \frac{\lambda}{10} \qquad \text{Equation 1}$$

(h: a height difference between the first and second radiators, λ: a wavelength of a radio wave radiated through the first radiator)

According to an embodiment, based on a lateral distance between the first radiator 540 and the second radiator 550, the efficiency of forming a reflected wave at the second radiator 550 or the mutual coupling value between the antenna modules may be determined.

Besides, a PCB 510, feeders 521 and 522, and a dielectric 530 are the same as or similar to the PCB, the feeder, and the dielectric in the above-described antenna module structure, so that repeated descriptions thereof will be omitted.

Figure 6:
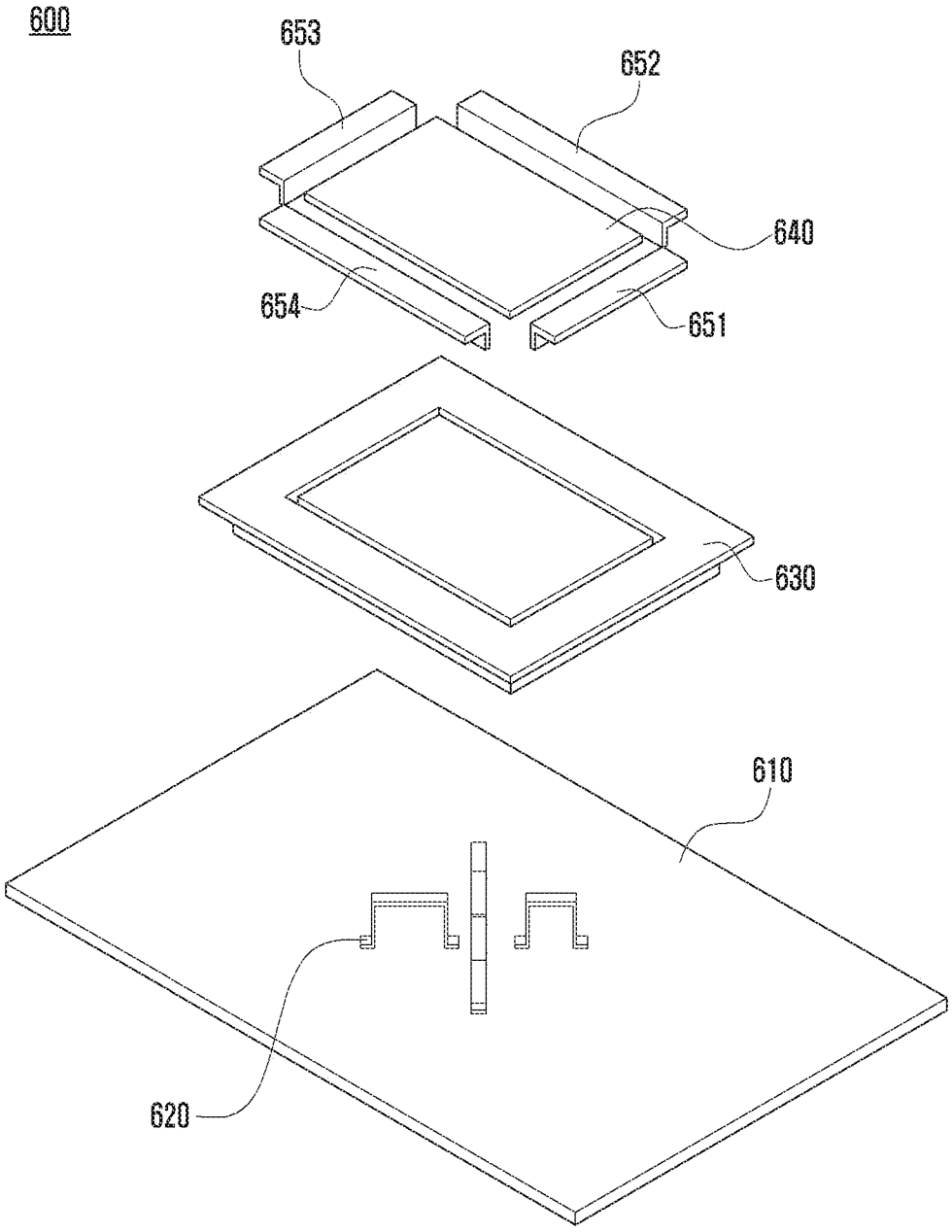
FIG. 6 is an exploded perspective view illustrating an antenna module structure including a plurality of separated second radiators according to an embodiment of the disclosure.

FIG. 6 is an exploded perspective view illustrating an antenna module structure including a plurality of separated second radiators according to an embodiment of the disclosure.

Referring to FIG. 6, an antenna module 600 is shown in which second radiators 651, 652, 653 and 654 may be separated from each other and disposed along the outer periphery of a first radiator 640. For example, when the first radiator 640 has a rectangular shape as shown, four separated second radiators 651, 652, 653 and 654 may be disposed to correspond to four sides of the rectangular first radiator 640, respectively.

According to an embodiment, each of the separated second radiators may include a first segment disposed in parallel with an upper surface of the first radiator 640, and a second segment extending from an inner end of the first segment toward a PCB 610. The second segment may be combined with a dielectric 630.

According to an embodiment, the inductance or capacitance characteristics of an antenna module 600 may be determined based on the area of an upper surface of the first segment. Therefore, the upper surface of the first segment may act as adding a capacitance component to the antenna module 600, thereby expanding a frequency bandwidth of the antenna module 600.

According to an embodiment, the height of the upper surface of the first segment may be greater than the height of the upper surface of the first radiator 640. This may block a radio wave radiated through the first radiator 640 from passing through the second radiators 651, 652, 653 and 654 and thus prevent the mutual coupling effect on neighboring antenna modules.

Except for the second radiator 450, the PCB 610, a feeder 620, the dielectric 630, and the first radiator 640 are the same as or similar to those of the above-described antenna module structure, so that repeated descriptions thereof will be omitted.

FIGS. 7A to 7E are side views illustrating an antenna module structure according to various embodiments of the disclosure.

Figure 7A:
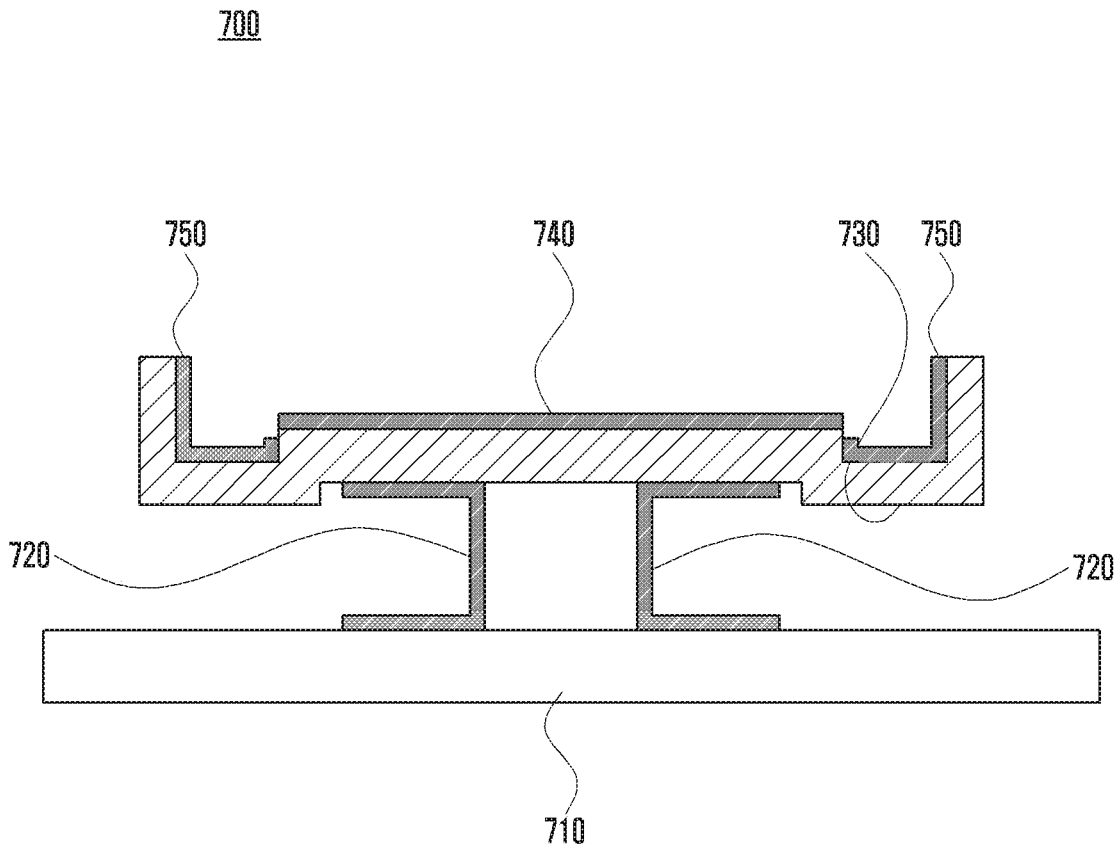
FIGS. 7A, 7B, 7C, 7D, and 7E are side views illustrating an antenna module structure according to various embodiments of the disclosure.

FIG. 7A shows an antenna module 700 in which the height of an upper surface of a second radiator 750 is greater than the height of an upper surface of a first radiator 740. In this case, the second radiator 750 may extend toward the first radiator 740 along the outer periphery of a dielectric 730 as shown. A feeder 720 may be disposed under the dielectric 730 and supply an electrical signal from a PCB 710 to the first radiator 740 via the dielectric 730. In addition, a part of a radio wave emitted by the first radiator 740 may be reflected by the second reflector 750 and then radiated to the outside of the antenna module 700. This may improve a gain value of the antenna module 700.

Figure 7B:
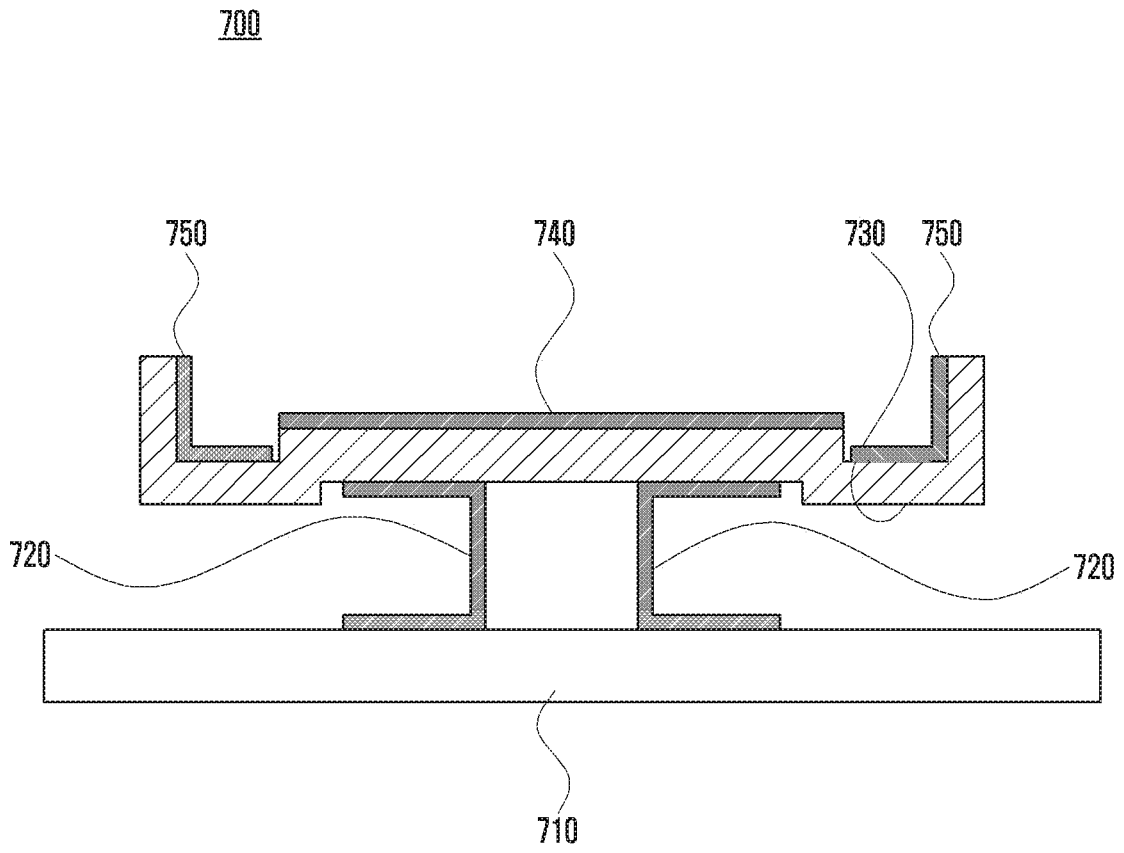

FIG. 7B shows the antenna module 700 in which the height of an upper surface of a second radiator 750 is greater than the height of an upper surface of a first radiator 740. The feeder 720 may be disposed under the dielectric 730 and supply an electrical signal from the PCB 710 to the first radiator 740 via the dielectric 730. In addition, a part of a radio wave emitted by the first radiator 740 may be reflected by the second reflector 750 and then radiated to the outside of the antenna module 700. This may improve a gain value of the antenna module 700.

Figure 7C:
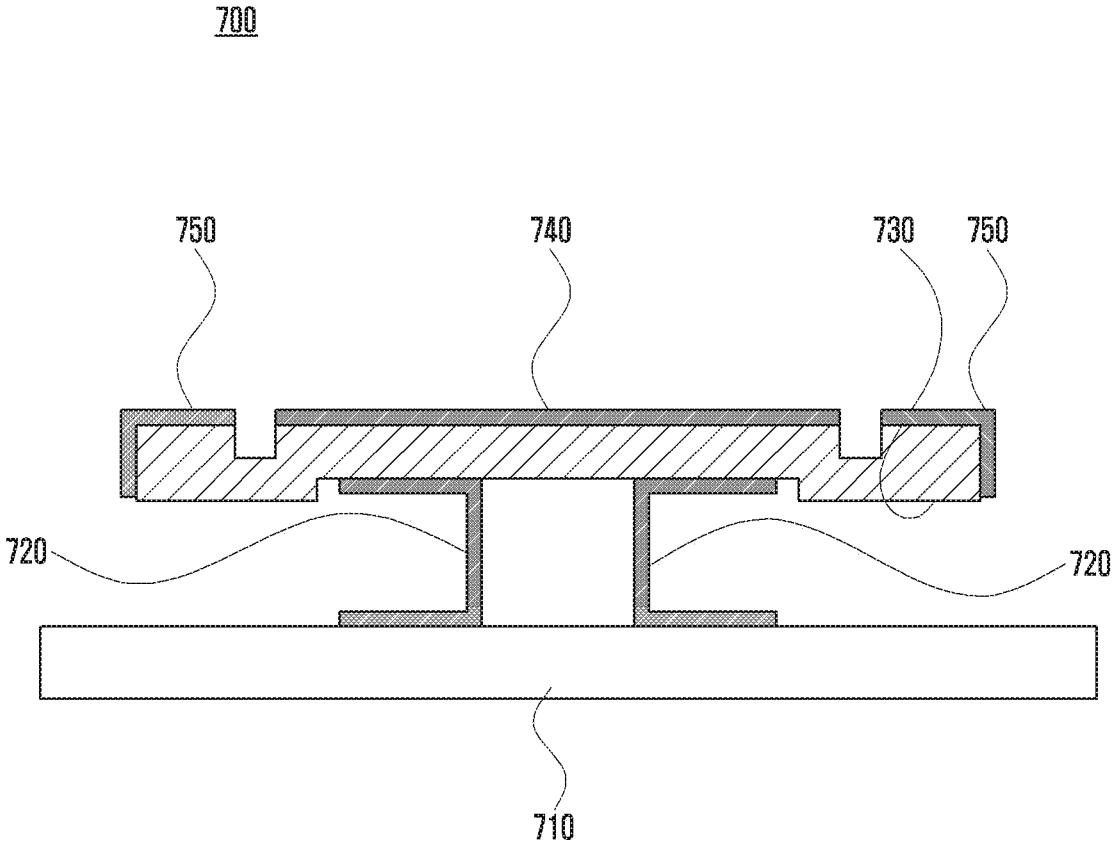

FIG. 7C shows the antenna module 700 in which the height of the upper surface of the second radiator 750 is equal to the height of the upper surface of the first radiator 740. In this case, the second radiator 750 may extend toward the first radiator 740 along the outer periphery of the dielectric 730 as shown. The feeder 720 may be disposed under the dielectric 730 and supply an electrical signal from the PCB 710 to the first radiator 740 via the dielectric 730.

Figure 7D:
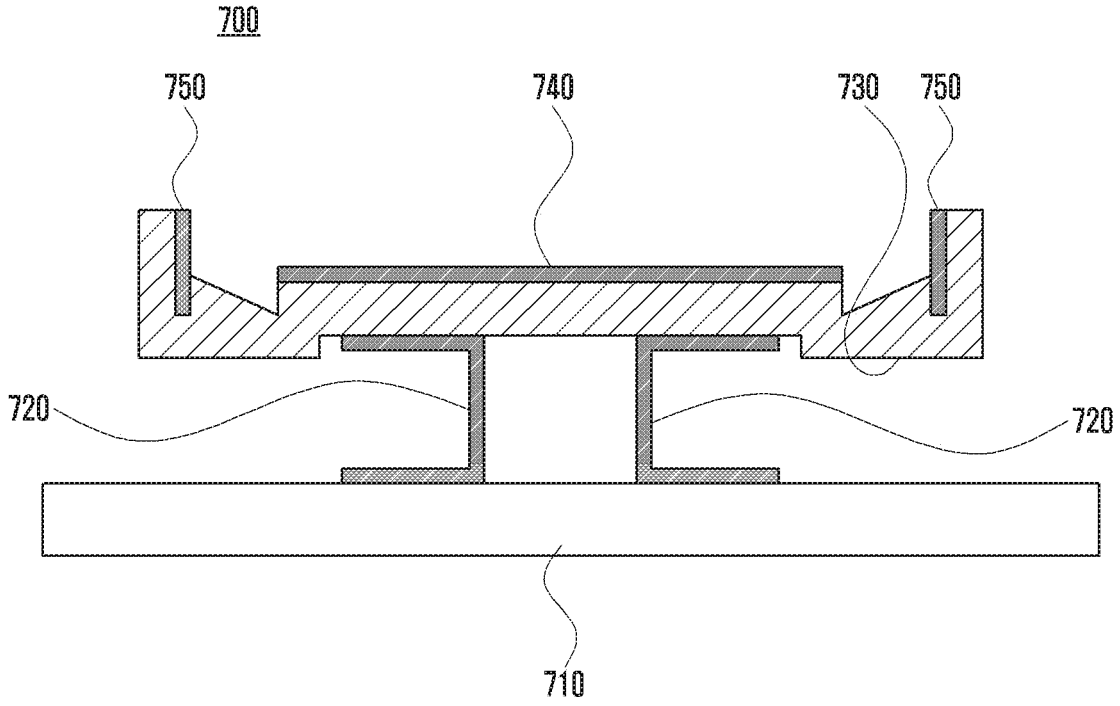

FIG. 7D shows the antenna module 700 in which the height of the upper surface of the second radiator 750 is greater than the height of the upper surface of the first radiator 740. In this case, the dielectric 730 may have an inclined surface between the first radiator 740 and the second radiator 750. This inclined surface of the dielectric 730 may prevent a radio wave radiated through the first radiator 740 from passing through the second radiator 750 and thus prevent the mutual coupling effect on neighboring antenna modules. The feeder 720 may be disposed under the dielectric 730 and supply an electrical signal from the PCB 710 to the first radiator 740 via the dielectric 730.

Figure 7E:
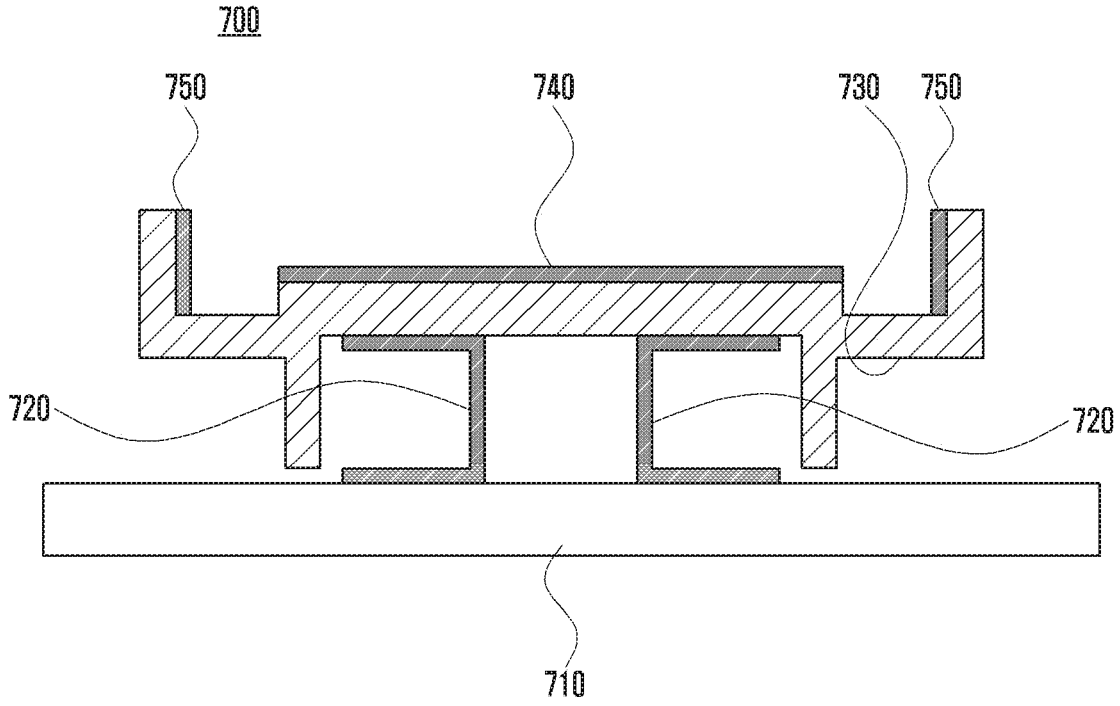

FIG. 7E shows the antenna module 700 in which in which the height of the upper surface of the second radiator 750 is equal to the height of the upper surface of the first radiator 740. The feeder 720 may be disposed under the dielectric 730 and supply an electrical signal from the PCB 710 to the first radiator 740 via the dielectric 730. In addition, a part of a radio wave emitted by the first radiator 740 may be reflected by the second reflector 750 and then radiated to the outside of the antenna module 700. This may improve a gain value of the antenna module 700.

Figure 8:
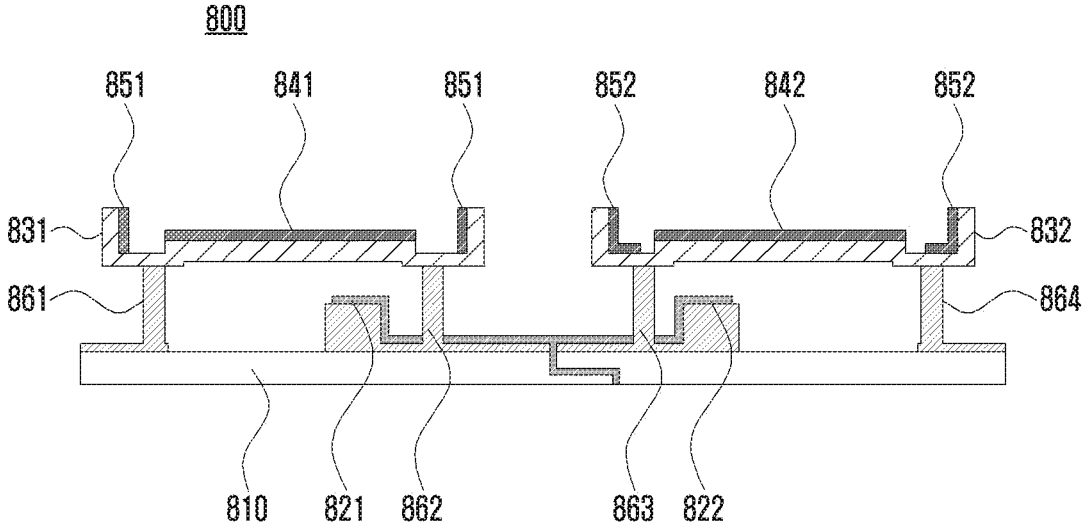
FIG. 8 is a side view illustrating an antenna array structure according to an embodiment of the disclosure.

FIG. 8 is a side view illustrating an antenna array structure according to an embodiment of the disclosure.

Referring to FIG. 8, an antenna array 800 may include two antenna modules. Specifically, in the antenna array 800, a first antenna module may be composed of a first radiator 841, a first dielectric 831, a second radiator 851, a first feeder 821, a first supporter 861, and a second supporter 862, and also a second antenna module may be composed of a third radiator 842, a second dielectric 832, a fourth radiator 852, a second feeder 822, a third supporter 863, and a fourth supporter 864.

In the first antenna module, the first radiator 841 radiates a radio wave through an upper surface thereof, and the second radiator 851 is formed to surround laterally the first radiator 841. The first dielectric 831 has an upper surface disposed under a lower surface of the first radiator 841, and is formed to fix the first radiator 841 and the second radiator 851 to be spaced apart from each other by a predetermined first length. The first feeder 821 is disposed under the first dielectric 831 and delivers an electrical signal to the first radiator 841 through the first dielectric 831. The first supporter 861 and the second supporter 862 are disposed under the first dielectric 831. The PCB 810 is electrically connected to the first feeder 821 through a conductive pattern thereof and supplies the electrical signal to the first feeder 821.

According to an embodiment, a part of a radio wave radiated through the first radiator 841 may be reflected by the second radiator 851. Therefore, the antenna array 800 can improve a gain value thereof through the radio waves reflected by the second radiator 851.

According to an embodiment, the height of an upper surface of the second radiator 851 may be greater than the height of an upper surface of the first radiator 841. Because of such a difference in height, a radio wave radiated through the first radiator 841 may not pass through the second radiator 851. This structure of the first antenna module may minimize the mutual coupling effect on the second antenna module caused by the radio wave radiated through the first radiator 841.

According to an embodiment, the first feeder 821 may be spaced apart from the lower surface of the first dielectric 831 by a specific distance. This may increase a capacitance component between the first feeder 821 and the first radiator 841 and thereby improve a frequency bandwidth of the antenna array 800.

Figure 9:
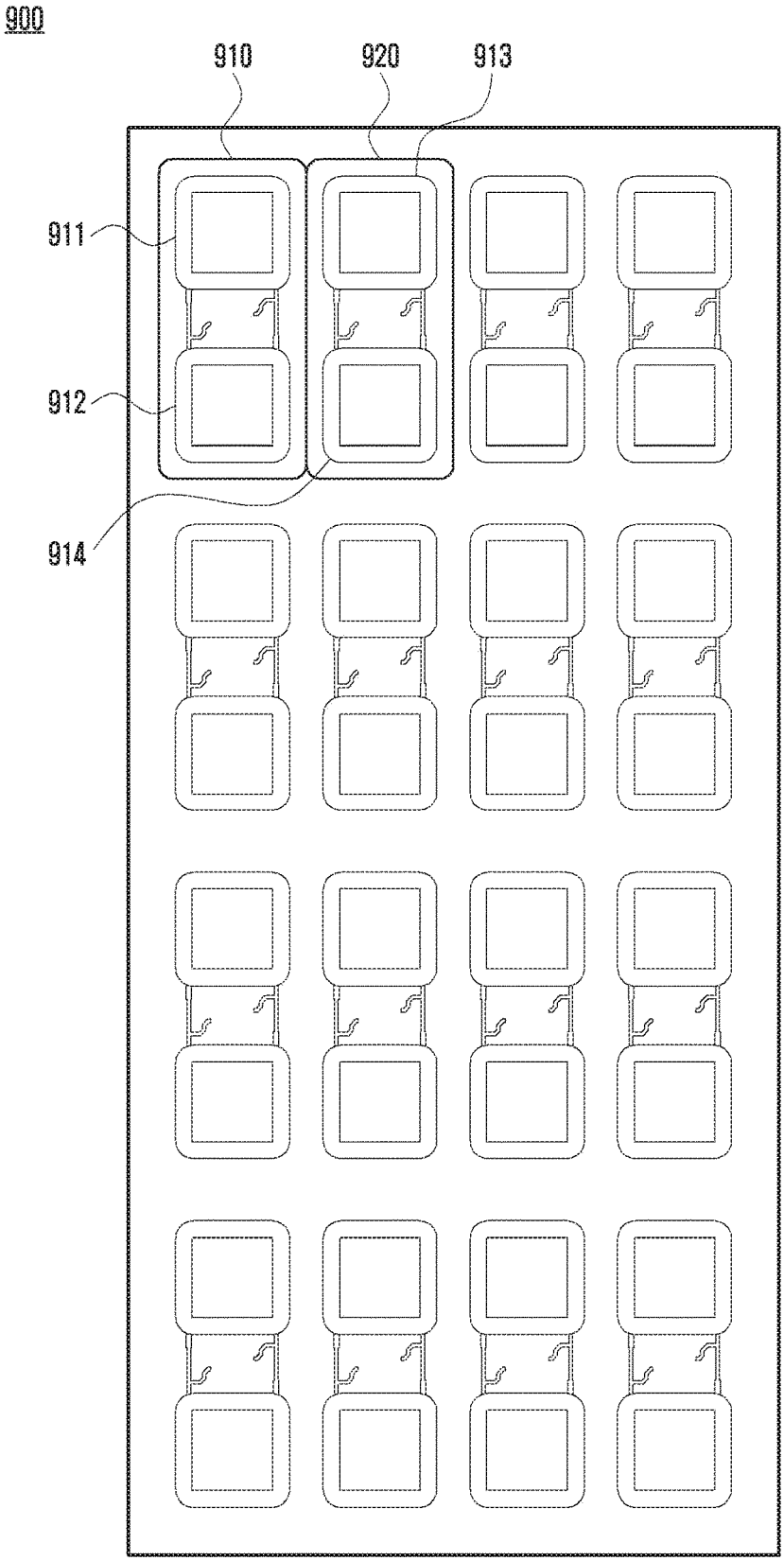
FIG. 9 is a top plan view illustrating an antenna array structure of a base station according to an embodiment of the disclosure.

FIG. 9 is a top plan view illustrating a base station according to an embodiment of the disclosure.

Referring to FIG. 9, a base station 900 may include a plurality of antenna arrays 910, 920, and the like. Although FIG. 9 shows only 16 antenna arrays included in the base station as an example, the number of antenna arrays included in the base station may be changed. For example, in a massive MIMO communication environment, 16 or more antenna arrays may be included in the base station.

According to an embodiment, the first antenna array 910 may include a first antenna module 911 and a second antenna module 912. Each of the first and second antenna modules 911 and 912 includes a first radiator radiating a radio wave through an upper surface thereof, a second radiator formed to surround laterally the first radiator, a dielectric having an upper surface disposed under a lower surface of the first radiator, the dielectric being formed to fix the first radiator and the second radiator to be spaced apart from each other by a predetermined first length, a feeder having an upper surface disposed under a lower surface of the dielectric, the feeder delivering an electrical signal to the first radiator or the second radiator through the dielectric, and a PCB electrically connected to the feeder through a conductive pattern thereof and supplying the electrical signal to the feeder.

According to an embodiment, a part of the radio wave radiated from the first radiator to the second antenna module 912 or the second antenna array 920 may be blocked by the second radiator formed in the first antenna module 911. That is, the second radiator included in each antenna module blocks a part of the radio wave radiated from the first radiator, so that a mutual coupling phenomenon between the antenna modules or between the antenna arrays can be minimized. Therefore, compared to a related-art structure, the antenna module structure including the second radiator allows a distance between the antenna modules to be reduced. This is advantageous to a smaller base station and to a beamforming operation of the next generation mobile communication system.

According to an embodiment, a part of the radio wave radiated through the first radiator included in the first antenna module 911 may be reflected by the second radiator and radiated to the outside of the antenna module 911. Therefore, the radiation effective area of the first antenna module 911 can be wider than that of a case where the radio wave is radiated only through the first radiator, and thus the gain value of the first antenna module 911 can be improved.

The operations of the third antenna module 913 and the fourth antenna module 914 constituting the second antenna array 920 are the same as or similar to those of the first antenna module 911 and the second antenna module 912.

Figure 10:
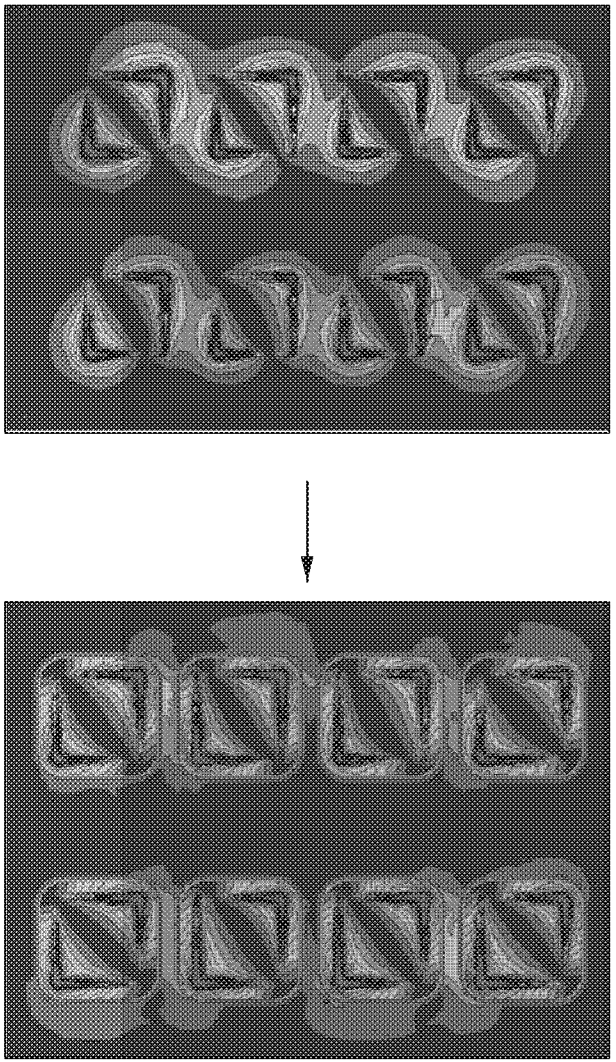
FIG. 10 is a view illustrating a distribution of an electromagnetic field radiated through a base station according to an embodiment of the disclosure.

FIG. 10 is a view illustrating a distribution of an electromagnetic field radiated through a base station according to an embodiment of the disclosure.

A mutual coupling phenomenon may occur between antenna modules constituting an antenna array of the base station. Thus, a radio wave radiated through each antenna module may cause interference to neighboring antenna modules.

Referring to FIG. 10, the electromagnetic field generated by each antenna module included in a related-art base station affects the electromagnetic field of the neighboring antenna module.

In contrast, according to the disclosure, each of antenna modules constituting an antenna array of the base station includes a reflector for preventing the radio wave radiated through each antenna module from passing to neighboring antenna modules. As a result, the isolation between the antenna modules can be improved as shown in FIG. 10.

Specifically, as shown in FIG. 10, the electromagnetic field generated by each antenna module according to the disclosure does not affect the electromagnetic field of the neighboring antenna module. In addition, the electromagnetic field of the radio wave radiated through each antenna module is greater in strength than that of a related-art antenna module.

Therefore, according to the disclosure, even if a distance between the antenna modules is not sufficient in the base station, the mutual coupling phenomena between the antenna modules can be reduced through the reflector disposed in the antenna module.

As described above, in the antenna module structure according to the disclosure, the second radiator surrounding the first radiator reflects a part of the radio waves radiated through the first radiator. Therefore, this antenna module structure can improve the gain value of the antenna module.

In addition, the second radiator blocks a part of the radio waves radiated from the first radiator to the neighboring antenna modules. Therefore, this antenna module structure can minimize the mutual coupling phenomenon caused by radio wave leakage between the antenna modules.

Furthermore, only arranging the second radiator can improve the isolation performance between the antenna modules constituting the base station, and also reduce a distance between the antenna modules. This is advantageous to a smaller base station and to a beamforming operation of the next generation mobile communication system.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An antenna module of a wireless communication system, the antenna module comprising:

a first radiator configured to radiate a radio wave through an upper surface;

a second radiator formed so as to surround an outer periphery of the first radiator;

a dielectric having an upper surface disposed under a lower surface of the first radiator, the dielectric being formed to fix the first radiator and the second radiator to be separated from each other based on a predetermined first length;

a feeder having an upper surface disposed under a lower surface of the dielectric, the feeder coupling an electrical signal to at least one of the first radiator or the second radiator through the dielectric; and a printed circuit board (PCB) electrically connected to the feeder by a conductive pattern and supplying the electrical signal to the feeder, wherein a height of an upper surface of the second radiator is greater than or equal to a height of an upper surface of the first radiator, wherein one side surface of the second radiator facing the outer periphery of the first radiator, and wherein a part of the radio wave radiated by the first radiator is reflected by the one side surface of the second radiator and then radiated to an outside of the antenna module.

2. The antenna module of claim 1, wherein the lower surface of the first radiator and the upper surface of the feeder are separated based on a predetermined second length by the dielectric, and wherein the predetermined second length is determined based on frequency characteristics of the radio wave radiated by the first radiator.

3. The antenna module of claim 1, wherein the second radiator is formed of a barrier having a predetermined height which surrounds laterally the first radiator.

4. The antenna module of claim 1, wherein a height difference between the first radiator and the second radiator is determined based on frequency characteristics of the radio wave radiated by the first radiator.

5. The antenna module of claim 1, wherein a plurality of sub-second radiators segmented from the second radiator are disposed along the outer periphery of the first radiator, and wherein each of the sub-second radiators includes a first segment disposed in parallel with the upper surface of the first radiator, and a second segment extending from an end of the first segment toward the PCB.

6. The antenna module of claim 5, wherein an area of an upper surface of the first segment is determined based on frequency characteristics of the radio wave radiated by the first radiator.

7. The antenna module of claim 5, wherein a height of an upper surface of the first segment is greater than a height of the upper surface of the first radiator.

8. The antenna module of claim 1, further comprising:

a supporter formed of a metallic material and disposed under the lower surface of the dielectric so that an upper surface of the PCB is separated from the lower surface of the dielectric based on a predetermined third length.

9. A base station comprising:

at least one antenna module, wherein the at least one antenna module includes:

a first radiator configured to radiate a radio wave through an upper surface;

a second radiator formed so as to surround an outer periphery of the first radiator;

a dielectric having an upper surface disposed under a lower surface of the first radiator, the dielectric being formed to fix the first radiator and the second radiator to be separated from each other based on a predetermined first length;

a feeder having an upper surface disposed under a lower surface of the dielectric, the feeder coupling an electrical signal to at least one of the first radiator or the second radiator through the dielectric; and a printed circuit board (PCB) electrically connected to the feeder by a conductive pattern and supplying the electrical signal to the feeder, and wherein a height of an upper surface of the second radiator is greater than or equal to a height of an upper surface of the first radiator, wherein one side surface of the second radiator facing the outer periphery of the first radiator, and wherein a part of the radio wave radiated by the first radiator is reflected by the one side surface of the second radiator and then radiated to an outside of the antenna module.

10. The base station of claim 9, wherein the lower surface of the first radiator and the upper surface of the feeder are separated based on a predetermined second length by the dielectric, and wherein the predetermined second length is determined based on frequency characteristics of the radio wave radiated by the first radiator.

11. The base station of claim 9, wherein the second radiator is formed of a barrier having a predetermined height which surrounds laterally the first radiator.

12. The base station of claim 9, wherein a height difference between the first radiator and the second radiator is determined based on frequency characteristics of the radio wave radiated by the first radiator.

13. The base station of claim 9, wherein a plurality of sub-second radiators segmented from the second radiator are disposed along the outer periphery of the first radiator.

14. The base station of claim 13, wherein each of the sub-second radiators includes a first segment disposed in parallel with the upper surface of the first radiator, and a second segment extending from an end of the first segment toward the PCB.

15. The base station of claim 14, wherein an area of an upper surface of the first segment is determined based on frequency characteristics of the radio wave radiated by the first radiator.

16. The base station of claim 14, wherein a height of an upper surface of the first segment is greater than a height of the upper surface of the first radiator.

17. The base station of claim 9, wherein the at least one antenna module further includes:

a supporter formed of a metallic material and disposed under the lower surface of the dielectric so that an upper surface of the PCB is separated from the lower surface of the dielectric based on a predetermined third length.

18. A base station comprising:

a plurality of antenna arrays, wherein each of the plurality of antenna arrays includes at least one antenna module, wherein each of the at least one antenna module includes:

a first radiator configured to radiate a radio wave through an upper surface;

a second radiator formed so as to surround an outer periphery of the first radiator;

a dielectric having an upper surface disposed under a lower surface of the first radiator, the dielectric being formed to fix the first radiator and the second radiator to be separated from each other based on a predetermined first length;

a feeder having an upper surface disposed under a lower surface of the dielectric, the feeder coupling an electrical signal to at least one of the first radiator or the second radiator through the dielectric; and a printed circuit board (PCB) electrically connected to the feeder by a conductive pattern and supplying the electrical signal to the feeder, and wherein a height of an upper surface of the second radiator is greater than or equal to a height of an upper surface of the first radiator, wherein one side surface of the second radiator facing the outer periphery of the first radiator, and wherein a part of the radio wave radiated by the first radiator is reflected by the one side surface of the second radiator and then radiated to an outside of the antenna module.

19. The base station of claim 18, wherein a part of the radio wave radiated by the first radiator is reflected by the second radiator and then radiated to an outside of the antenna module.

20. The base station of claim 18, wherein the antenna array includes a first antenna module and a second antenna module, wherein the first antenna module includes:

a third radiator radiating a radio wave through an upper surface; and a fourth radiator formed to surround laterally the upper surface of the third radiator, and wherein a part of the radio wave radiated from the upper surface of the third radiator to the second antenna module is blocked by the fourth radiator.

* * * * *